US008433236B2

(12) United States Patent
Azuma et al.

(10) Patent No.: US 8,433,236 B2
(45) Date of Patent: Apr. 30, 2013

(54) PAPER PROCESSING APPARATUS AND IMAGE FORMING APPARATUS

(75) Inventors: Terumitsu Azuma, Aichi (JP); Shigefumi Soga, Aichi (JP); Takeshi Hirabayashi, Aichi (JP); Kentaro Fukami, Aichi (JP); Daishi Watanabe, Aichi (JP); Kazumasa Takeuchi, Aichi (JP); Hiroki Yoshida, Aichi (JP)

(73) Assignee: Ricoh Company, Ltd., Tokyo (JP)

( * ) Notice: Subject to any disclaimer, the term of this patent is extended or adjusted under 35 U.S.C. 154(b) by 292 days.

(21) Appl. No.: 12/923,499

(22) Filed: Sep. 24, 2010

(65) Prior Publication Data

US 2011/0091260 A1 Apr. 21, 2011

(30) Foreign Application Priority Data

Oct. 21, 2009 (JP) ..... 2009-242449

(51) Int. Cl.
*G03G 15/00* (2006.01)

(52) U.S. Cl.
USPC ..... 399/410; 271/207

(58) Field of Classification Search ..... 399/410; 271/207; 270/58.07, 58.08, 58.11, 58.12, 270/58.17, 58.27
See application file for complete search history.

(56) References Cited

U.S. PATENT DOCUMENTS

| | | | | |
|---|---|---|---|---|
| 5,639,078 | A * | 6/1997 | Mandel et al. | 270/58.12 |
| 6,851,609 | B2 | 2/2005 | Ando et al. | |
| 7,918,450 | B2 * | 4/2011 | Yoshida | 271/207 |
| 8,226,080 | B2 * | 7/2012 | Morita et al. | 270/58.13 |
| 2002/0050520 | A1 | 5/2002 | Ando et al. | |
| 2004/0212136 | A1 * | 10/2004 | Yoshino | 270/58.08 |
| 2006/0076726 | A1 * | 4/2006 | Kato et al. | 270/58.11 |
| 2007/0020007 | A1 | 1/2007 | Azuma | |
| 2008/0290577 | A1 * | 11/2008 | Kushida | 270/1.01 |
| 2010/0019435 | A1 * | 1/2010 | Fukami | 270/58.11 |
| 2010/0019442 | A1 | 1/2010 | Yoshida | |
| 2010/0019446 | A1 * | 1/2010 | Matsumoto et al. | 271/302 |

FOREIGN PATENT DOCUMENTS

| | | | |
|---|---|---|---|
| JP | 3284782 | B2 | 4/1996 |
| JP | 4047091 | B2 | 2/2004 |
| JP | 2008-030923 | A | 2/2008 |

OTHER PUBLICATIONS

English abstract for JP-2004-059313 published Feb. 26, 2004 (which corresponds to JP-4047091-B2).
English abstract for JP-08-091686 published Apr. 9, 1996 (which corresponds to JP-3284782-B2).

* cited by examiner

*Primary Examiner* — Matthew G Marini
*Assistant Examiner* — Allister Primo
(74) *Attorney, Agent, or Firm* — Harness, Dickey & Pierce, PLC

(57) ABSTRACT

A paper processing apparatus includes: a discharging unit that discharges the paper onto a staple tray; a paper returning unit that reverses the paper discharged by the discharging unit and performs alignment in a conveying direction by abutting the paper against a rear end reference fence; a supporting unit that supports the discharging unit in a state capable of coming in contact with or separating from the paper; a contact and separation unit by which the discharging unit comes in contact with or separates from the paper; and a pressurizing unit that is moved by the contact and separation unit, does not load the discharging unit in a standby state where the discharging unit is held apart from the paper, and applies contact pressure in a state where the discharging unit is in contact with the paper.

5 Claims, 8 Drawing Sheets

PAPER PROCESSING APPARATUS AND IMAGE FORMING APPARATUS

CROSS-REFERENCE TO RELATED APPLICATIONS

The present application claims priority to and incorporates by reference the entire contents of Japanese Patent Application No. 2009-242449 filed in Japan on Oct. 21, 2009.

BACKGROUND OF THE INVENTION

1. Field of the Invention

The present invention relates to a paper processing apparatus that performs a predetermined process on a sheet recording medium brought in (referred to as "paper" in this specification) and an image forming apparatus that includes this paper processing apparatus in the body, such as a copier, a printer, a facsimile, and a digital complex machine.

2. Description of the Related Art

Apparatuses called paper processing apparatuses or paper post-processing apparatuses, which are arranged at the rear stage of an image forming apparatus and that perform at least one process among processes such as aligning, sorting, stitching, and folding paper printed by the image forming apparatus, are in widespread use. Such apparatuses typically perform alignment while sorting, stitching, and folding paper. This type of paper processing apparatus usually includes a pair of discharging rollers (upper roller) that discharges paper and a discharge guide plate that rotates so as not to inhibit carrying-in of paper during the carrying-in and so as to surely discharge a bundle of paper during the discharging, for discharging an aligned paper bundle.

For example, inventions disclosed in Japanese Patent No. 4047091, Japanese Patent No. 3284782, and Japanese Patent Application Laid-open No. 2008-030923 are known as such techniques including a pair of discharging rollers and a discharge guide plate. Among them, Japanese Patent No. 4047091 discloses a sheet post-processing apparatus including: a paper conveying unit that conveys a sheet; an upper conveying guide that guides the upper surface of the sheet conveyed by the paper conveying unit and is vertically displaceable; a lower conveying guide that opposes the bottom of the upper conveying guide and that supports and guides the lower surface of the sheet conveyed by the paper conveying unit; an upper sheet ejecting rotating body and a lower sheet ejecting rotating body that eject and convey the sheet at the downstream of the upper conveying guide and the lower conveying guide and that are vertically arranged; an arm member that has the upper sheet ejecting rotating body and is vertically displaceable; a lifting unit that pushes the arm member upward and separates the upper sheet ejecting rotating body from the lower sheet ejecting rotating body; a sheet post-processing unit that is arranged downstream of the paper conveying unit in a paper conveying direction and that performs a process on the sheet stacked on the lower conveying guide; and an interlocking unit that displaces the upper conveying guide upward when the arm member is displaced upward by the lifting unit. The sheet post-processing unit, the upper sheet ejecting rotating body, and the lower sheet ejecting rotating body are arranged downstream of the paper conveying unit in a paper conveying direction in this order.

Japanese Patent No. 3284782 discloses a paper sheet post-processing apparatus for performing a post-process such as stitching and punching on the paper sheets discharged from an image formation section. The paper sheet post-processing apparatus includes: a compiling tray that has at least a paper sheet gathering paddle and a paper sheet aligning plate for aligning the paper sheets discharged from the image formation section; a paper sheet post-processing machine installed at the rear end part of the compiling tray; a loading tray for loading the paper sheets discharged from the compiling tray; and a set discharging roller that discharges the paper sheets aligned (set) by the compiling tray to the loading tray. The paper sheet post-processing apparatus is configured to make one end of the paper sheets on the compiling tray contact with the loading tray. The paper sheets discharged from the image formation section are set and discharged onto the loading tray via the compiling tray regardless of the existence of the post-process by the paper sheet post-processing machine.

Japanese Patent Application Laid-open No. 2008-030923 discloses a sheet post-processing device including: a stacking tray for stacking paper sheets to which image formation is applied; a guide roller for guiding paper sheets to the stacking tray; an alignment member for aligning paper sheets stacked on the stacking tray; a stitching processing unit for stitching the aligned paper sheets; and an ejection unit for pushing up a paper sheet bundle stitched in the paper delivery direction and ejecting the paper sheet bundle from the stacking tray. The guide roller is arranged in the position opposite to the stacking tray. When the paper sheet bundle guided to the stacking tray is ejected from the stacking tray, the guide roller is driven in the direction reverse to the rotating direction at the time of guiding of paper sheets to the stacking tray.

Among them, Japanese Patent No. 4047091 discloses the sheet post-processing apparatus in which a pair of discharging rollers (upper roller) and a discharge guide plate are rotated by a cam positioned below the pair of discharging rollers. Japanese Patent No. 3284782 discloses the paper sheet post-processing apparatus in which a discharge guide supported upward by a spring is rotated by a cam in a direction against the spring. Japanese Patent Application Laid-open No. 2008-030923 discloses the sheet post-processing device in which rotation is applied by a link mechanism provided at the upper side of an opening and closing guide plate.

The invention disclosed in Japanese Patent No. 4047091 configured as described above is difficult to respond to changes in the thickness of paper or a bundle of paper because paper is discharged by the weight of the pair of discharging rollers (upper roller) itself and by alternatively arranging the pair of discharging rollers. Therefore, non-feeding of paper, folded lines, or similar failures may occur. In the invention disclosed in Japanese Patent No. 3284782, the guide is rotated and the discharging roller is pressurized against the spring, and therefore, the load on paper becomes large, and the pressurization on paper becomes unstable. Moreover, in the invention disclosed in Japanese Patent Application Laid-open No. 2008-030923, the opening and closing guide plate is moved by the link mechanism provided at the upper side of the opening and closing guide plate, and therefore, a space is required above the opening and closing guide plate. This results in a large apparatus as a whole, and thus, the demand for downsizing the apparatus cannot be satisfied.

The present invention provides a paper processing apparatus that can be mounted on and discharge paper in a limited space, that is, the body of an image forming apparatus, has stable conveying force regardless of the thickness of paper and of a bundle of paper, and can perform paper process without damaging paper.

SUMMARY OF THE INVENTION

It is an object of the present invention to at least partially solve the problems in the conventional technology.

According to one aspect of the present invention, there is provided a paper processing apparatus including a staple tray on which paper conveyed from a previous stage is temporarily stacked, aligned, and stapled to be discharged onto a discharge tray, the paper processing apparatus including: a discharging unit that discharges the paper onto the staple tray; a paper returning unit that reverses the paper discharged by the discharging unit and performs alignment in a conveying direction by abutting the paper against a rear end reference fence; a supporting unit that supports the discharging unit in a state capable of coming in contact with or separating from the paper; a contact and separation unit by which the discharging unit comes in contact with or separates from the paper; and a pressurizing unit that is moved by the contact and separation unit, does not load the discharging unit in a standby state where the discharging unit is held apart from the paper, and applies contact pressure in a state where the discharging unit is in contact with the paper.

According to another aspect of the present invention, there is provided an image forming apparatus comprising the paper processing apparatus mentioned above.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

Figure 1:
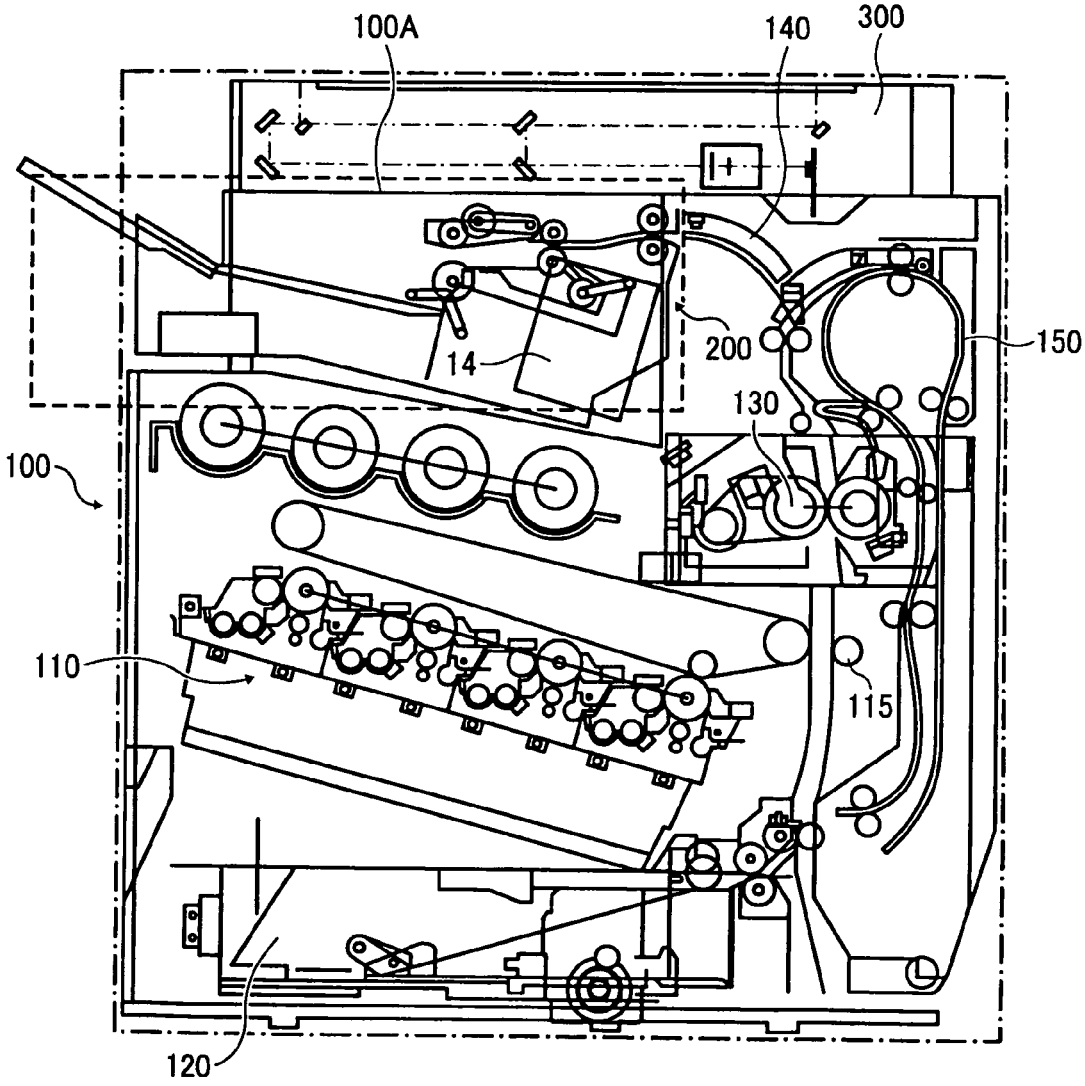
FIG. 1 is a schematic elevation of an image forming apparatus according to an embodiment of the present invention.

An embodiment of the present invention is described below with reference to the drawings. In the following description, similar units are given with the same reference numerals to omit overlapping description as appropriate.

FIG. 1 is a schematic elevation of an image forming apparatus according to an embodiment of the present invention. In FIG. 1, the image forming apparatus according to the embodiment includes an image forming apparatus main body 100, a post-processing apparatus 200 as a paper processing apparatus, and an image reading apparatus 300.

The image forming apparatus main body 100 substantially includes an image forming unit 110 that includes a tandem image forming unit with four colors, a transfer unit 115 that transfers images formed by the image forming unit 110, a feeding unit 120 that feeds paper to the transfer unit 115, a fixing unit 130 that fixes the images transferred by the transfer unit 115, a discharging unit 140 that discharges paper on which the images are fixed, and a reversing unit 150 that reverses paper and leads it to the transfer unit 115 when images are formed also on the back surface of the paper. The function and structure of each of these units are known, and therefore, the description of each unit is omitted.

The image reading apparatus 300 includes a first mirror to a third mirror and leads light reflected on an original to a photoelectric converter such as a charge-coupled device (CCD) in a reduction optical system to digitize the light and perform a predetermined image data correction. Subsequently, the image reading apparatus 300 transmits the data as data available as print data to a controller (not, illustrated) of the image forming apparatus 100.

Figure 2:
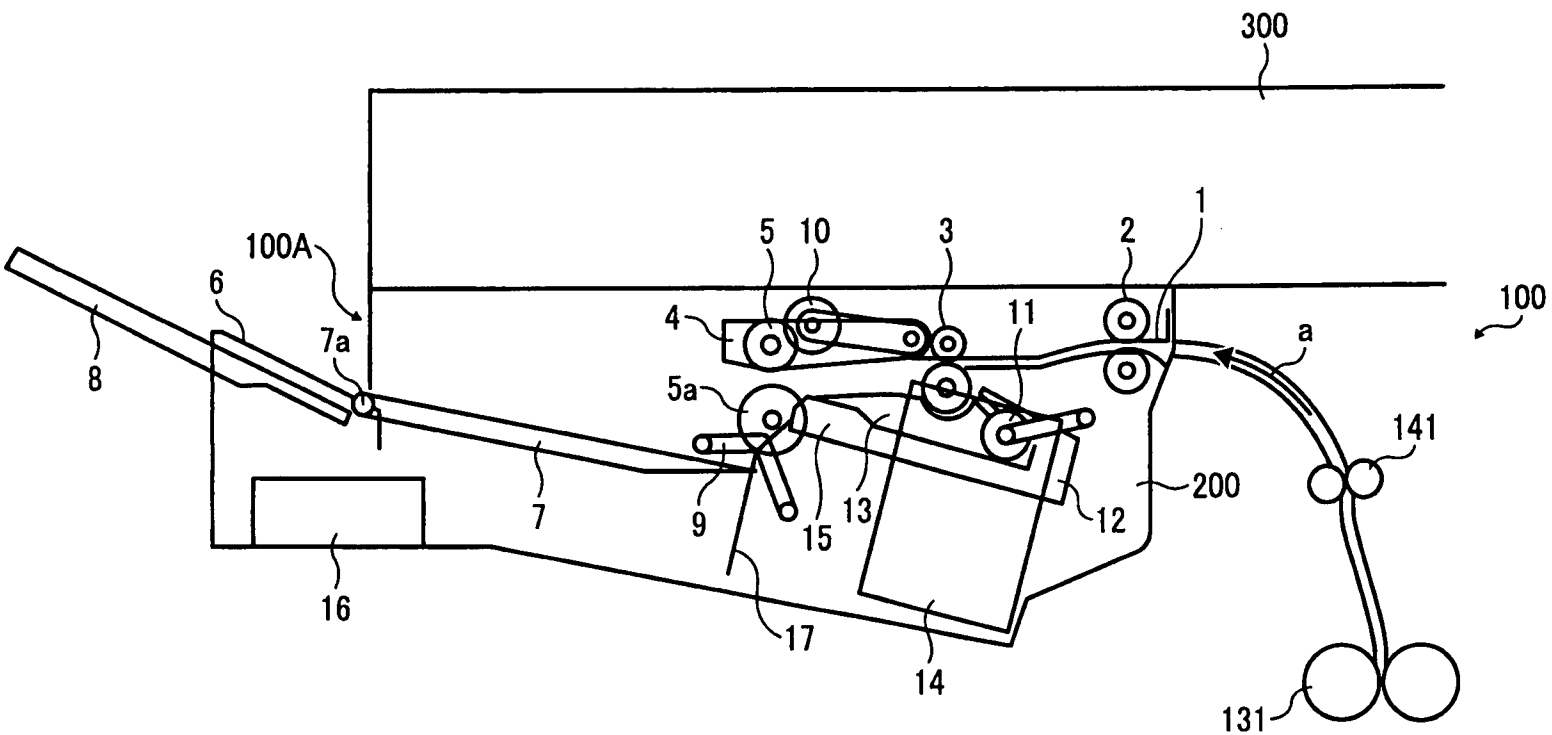
FIG. 2 is a schematic elevation of a post-processing apparatus.

FIG. 2 is a schematic elevation of the post-processing apparatus 200. The post-processing apparatus 200 is a compact post-processing apparatus installed in a space between the image forming apparatus main body 100 and the image reading apparatus 300, that is, in a body 100A.

The post-processing apparatus 200 includes two trays of a staple tray 15 on which paper is temporarily stacked for stitching the paper and a discharge tray 6 on which paper or a bundle of paper discharged is stacked. The staple tray 15 section includes a tapping roller 10, a rear end returning roller 11, and a rear end reference fence 12 that align paper on the staple tray 15 in a paper conveying direction (sub-scanning direction), and a jogger fence 13 that aligns the paper in a direction orthogonal to the paper conveying direction (main scanning direction). Guide plates 1, a pair of inlet rollers 2, a pair of shift rollers 3, and an opening and closing discharge guide plate 4 (abbreviated as a discharge guide plate in this specification) are installed in this order from the inlet along the conveying path. A driven discharging roller 5 is provided at the opening and closing end of the discharge guide plate 4. A driving discharging roller 5*a*, paired with the driven discharging roller 5, is provided most downstream of the staple tray 15 in a paper conveying direction. When the discharge guide plate 4 is closed, paper or a bundle of paper is pinched by a nip between the rollers so as to be imparted with conveying force.

The tapping roller 10 is provided with a tapping roller supporting arm 10*a* as described with reference to FIGS. 4A and 4B below, a tapping solenoid (not illustrated), and a tapping motor (not illustrated). The tapping solenoid lifts and lowers the tapping roller supporting arm 10*a*, and the tapping motor drives the tapping roller 10 being in contact with paper to pull the paper to the rear end reference fence 12. The paper is further pulled by the rear end returning roller 11 to come in contact with the rear end reference fence 12 and is aligned in the paper conveying direction (longitudinal direction) of the paper. The tapping roller 10 is supported by the free end of the tapping roller supporting arm 10*a* and is swingably supported at a swing fulcrum 10*b*.

The jogger fence 13 catches both ends of the paper in a direction orthogonal to the paper conveying direction, aligns the paper in the direction orthogonal to the paper conveying direction (width direction), and is reciprocated for contact and separation by a jogger motor (not illustrated). A stapler 14 is provided at the rear end of the staple tray 15, and a staple process is performed on a bundle of paper aligned in both of the length direction and the width direction by the rear end reference fence 12 and the jogger fence 13.

The discharge guide plate 4 changes the spacing between the pair of discharging rollers 5 and 5*a* at the discharge outlet while paper is discharged onto the discharge tray 6. The discharge guide plate is driven by a discharge motor for opening and closing.

A rear end presser 9 that detects paper surface height and presses the rear end of paper is provided in the discharge tray 6 section so as to maintain the height of the top surface of paper sheets stacked and a discharge section at a constant height. The discharge tray 6 is provided with a discharge tray movable unit 7 that repeats lifting and lowering action on each predetermined number of sheets of paper by a lifting motor (not illustrated) and an auxiliary tray 8. The free end of the discharge tray movable unit 7 is set on the side closer to an end fence 17 of the post-processing apparatus 200, and paper is aligned by abutting the rear end of the paper against the end fence 17 provided at the post-processing apparatus 200. A swing fulcrum 7*a* is set at a position where the main body of the discharge tray 6 is preset. The discharge tray movable unit 7 is swingably supported at the swing fulcrum 7*a*, allowing the height of paper sheets stacked to be adjusted. The discharge tray movable unit 7 is driven to be lifted and lowered by a driving motor in a driving section (not illustrated), and the upstream side of the discharge tray movable unit 7 in a paper conveying direction moves up and down depending on the number of stacked sheets of paper. The auxiliary tray 8 is slidably provided at the back of the discharge surface of the discharge tray 6 and is used by being pulled out when the size of paper is large as needed.

A control board 16 on which a control circuit (not illustrated) is mounted is provided below the discharge tray 6 of the post-processing apparatus 200. Each of the image forming apparatus main body 100 and the image reading apparatus 300 also includes a control board (not illustrated) on which a control circuit is mounted. Each of the control circuits including the control circuit of the post-processing apparatus 200 includes a central processing unit (CPU), a read-only memory (ROM), and a random access memory (RAM). Each CPU develops program code stored in the ROM in the RAM and performs control based on the program code while using the RAM as a work area and a data buffer. The post-processing apparatus 200 and the image reading apparatus 300 are connected to each other via the control circuit and an interface in the image forming apparatus main body 100, transmit and receive necessary control information. The image reading apparatus 300 transmits print (image) data to be printed to the image forming apparatus main body 100.

Although not illustrated, the post-processing apparatus 200 appropriately includes paper detecting sensors used for the control of each unit at necessary positions along the paper conveying path. The CPU of the post-processing apparatus 200 operates each unit based on instruction information for post-processing transmitted from the control circuit of the image forming apparatus main body 100 and detection output of the paper detecting sensor provided at each position of the post-processing apparatus 200. Subsequently, the CPU performs the post-processing instructed from the image forming apparatus main body 100 on paper.

Figure 3A:
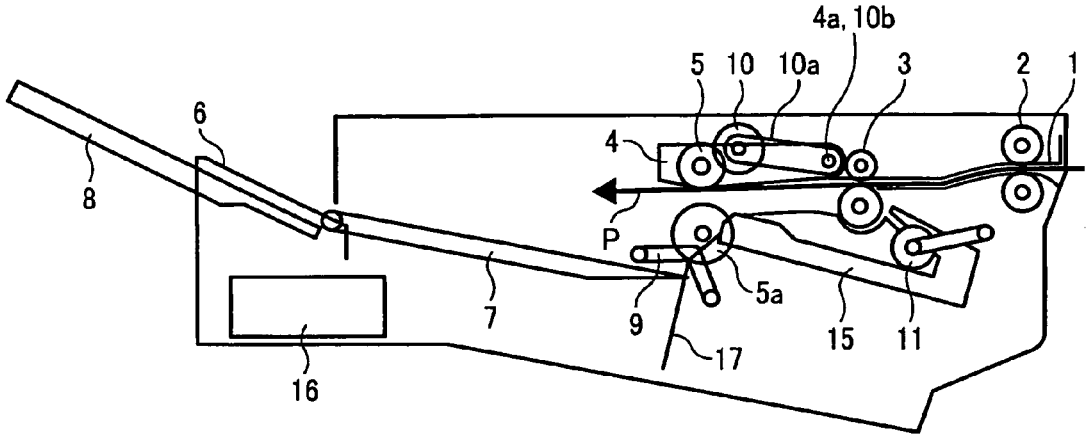
FIGS. 3A and 3B are schematic diagrams illustrating operation during straight discharge.
Figure 3B:
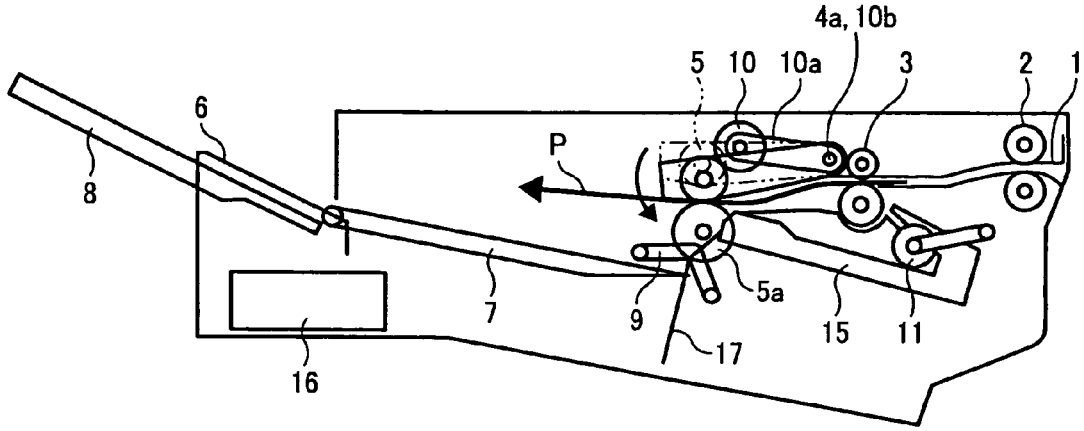

FIGS. 3A and 3B are schematic diagrams illustrating operation during straight discharge. In thus structured post-processing apparatus 200 to be installed in a body, a paper P (FIG. 2), which is passed through a main body fixing roller 131 and a main body discharging roller 141 and is conveyed in an arrow a direction, enters from the guide plate 1. During straight discharge, the paper P is further conveyed by the inlet rollers 2 and the staple discharging roller 3 in this order. The discharge guide plate 4 is closed to discharge the paper P onto the discharge tray 6 by the pair of discharging rollers 5 and 5*a*. The discharge tray movable unit 7 once descends each time the several sheets of paper are discharged and ascends in a state where the rear end of the paper is pressed by the rear end presser 9 that has been moved to a position not disturbing the discharge while the rear end passes through the pair of discharging rollers 5 and 5*a*. The rear end presser 9 acts on each sheet of paper. Although not illustrated, the rear end presser 9 detects the height of the paper surface.

The discharge guide plate 4 rotates around the rotation fulcrum 4*a* in both directions at a predetermined angle. The paper P is pinched by the nip between the pair of discharging rollers 5 and 5*a* by closing the discharge guide plate 4 and is discharged onto the discharge tray 6 by the conveying force of the pair of discharging rollers 5 and 5*a*. For sorting the paper P, after the rear end of the paper passes through the pair of inlet rollers 2, the paper is shifted by the pair of shift rollers 3 in a direction orthogonal to a paper conveying direction at a certain amount (for example, 15 millimeters in a positive direction and 15 millimeters in a negative direction from the center position of the conveying direction). The sorting is performed every one copy by this shifting action.

Figure 5:
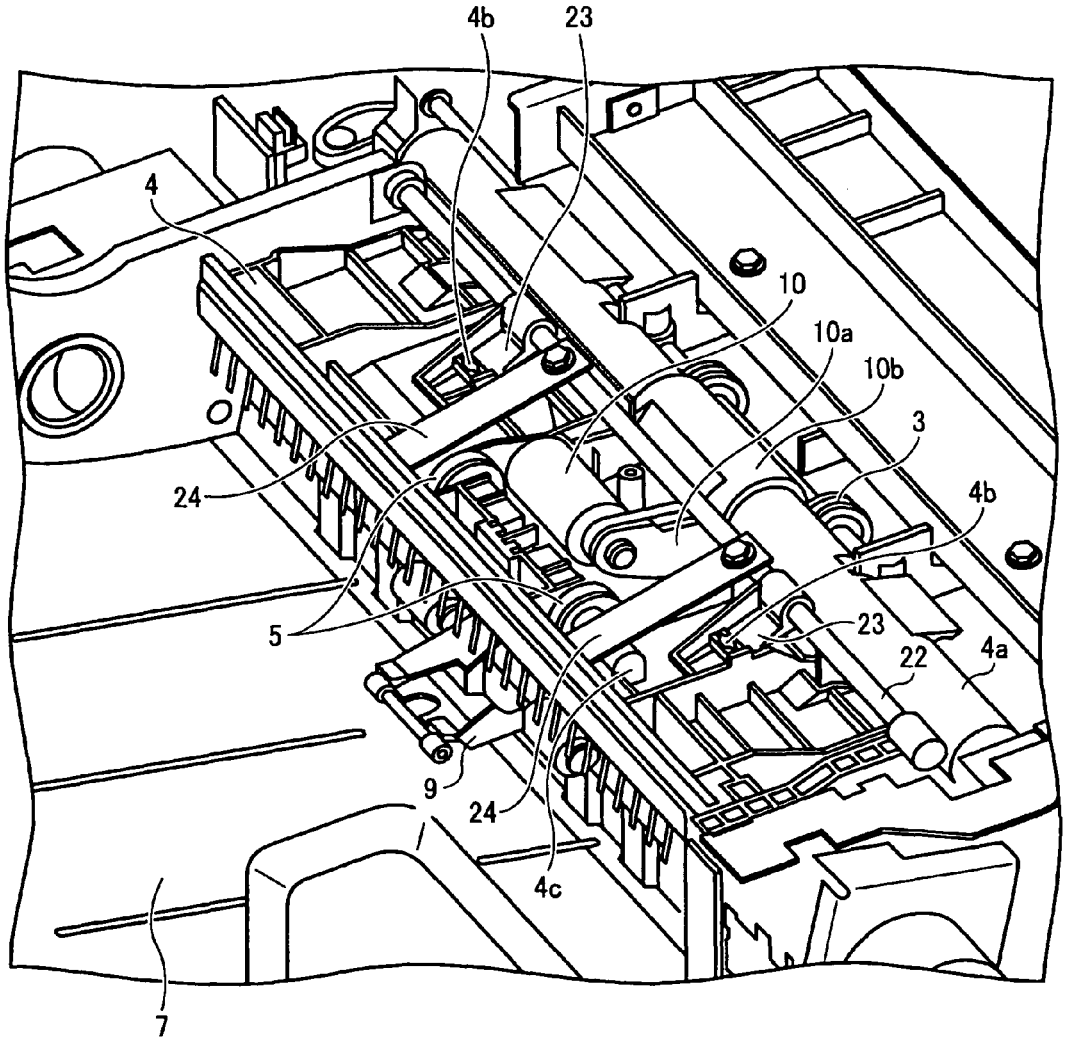
FIG. 5 is a perspective view of a substantial portion of a mechanism centered on a discharge guide plate of the post-processing apparatus of the embodiment.
Figure 6:
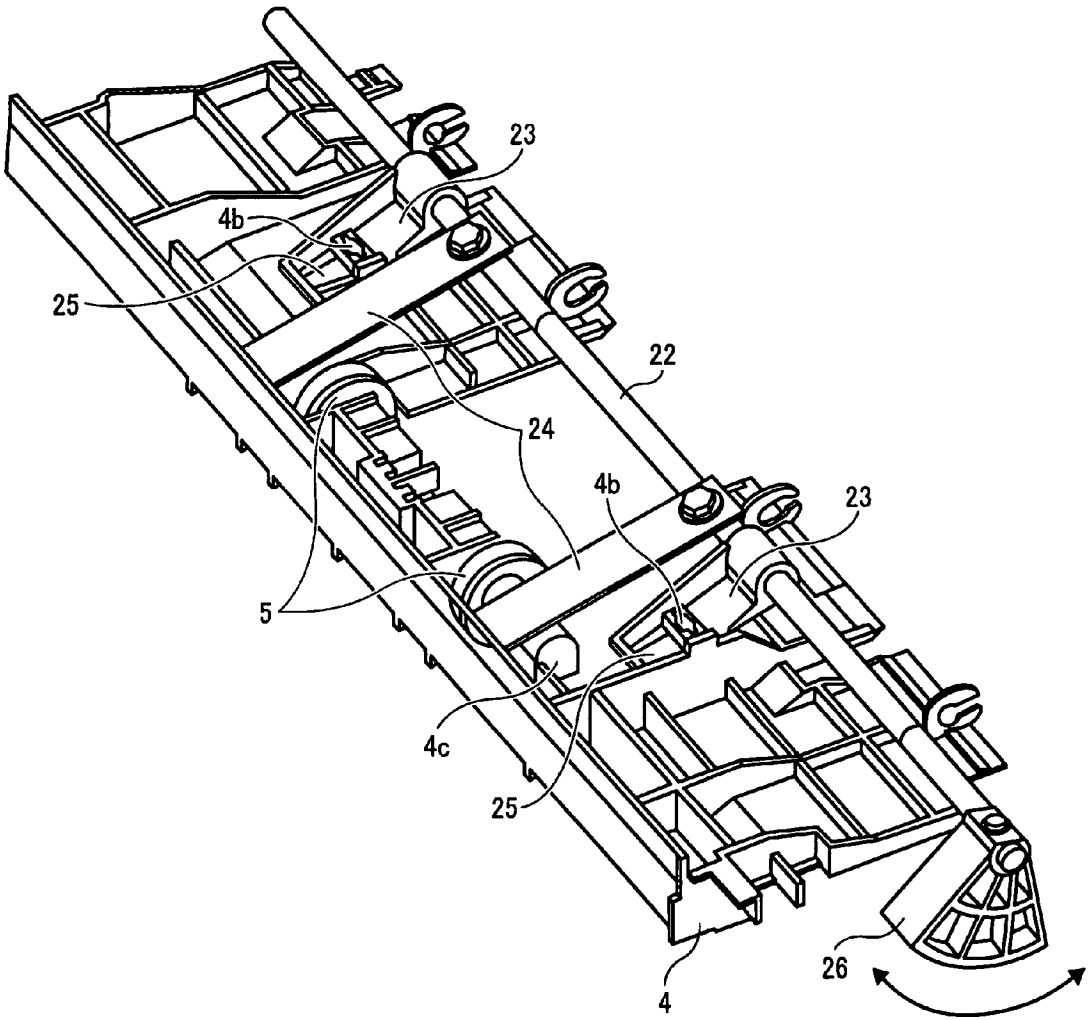
FIG. 6 is a perspective view of the discharge guide plate illustrated in FIG. 5.

FIG. 5 is a perspective view of a substantial portion of a mechanism centered on the discharge guide plate 4 of the post-processing apparatus 200 in the embodiment, and FIG. 6 is a perspective view of the discharge guide plate 4 in FIG. 5. In these figures, the discharge guide plate 4 is supported by a discharge guide plate supporting member 23 swingably provided at a rocking driving shaft 22 placed at a position in the post-processing apparatus 200 different from the position of the rotation fulcrum 4*a* of the discharge guide plate 4 itself via a boss 4*b* for supporting a discharge guide plate. A cushion 25 for a discharge guide plate is attached to the discharge guide plate supporting member 23 with an adhesive.

Figure 7:
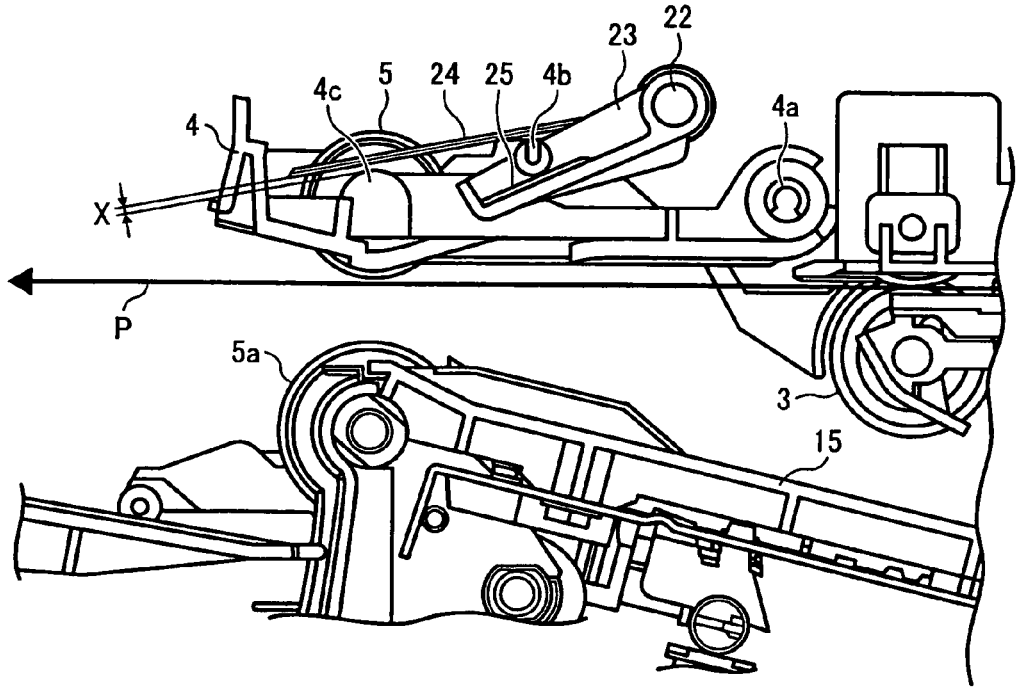
FIG. 7 is an elevation of an enlarged substantial portion illustrating a state near the discharge guide plate when the discharge guide plate is opened.

In other words, the discharge guide plate 4 is supported at two points of the rotation fulcrum 4*a* and the boss 4*b* for the discharge guide plate supporting member 23 rotatable around the rocking driving shaft 22. Among them, the rotation fulcrum 4*a* is positioned at the upstream end of the discharge guide plate 4 in a paper conveying direction, and the supported portion supported by the boss 4*b* is at substantially center of the discharge guide plate 4. With such a supporting mechanism, when the discharge guide plate 4 is opened (in the state of FIG. 7), the discharge guide plate 4 is supported upwardly from the staple tray 15 by the discharge guide plate supporting member 23, and the pair of discharging rollers 5 and 5*a* are separated. In this process, a gap X is formed between a discharge guide plate pressurizing member 24 provided as with the discharge guide plate supporting member 23 at the rocking driving shaft 22 of the discharge guide plate supporting member 23 and a discharge guide plate pressurizing portion 4*c*, and thus the discharge guide plate pressurizing member 24 is not loaded from the exterior. In other words, the discharge guide plate pressurizing member 24 is attached in an arrangement so that the gap X is formed. With such a structure, the discharge guide plate pressurizing member 24 loads the discharge guide plate 4 only as needed and does not unnecessarily load it, and therefore, the service life of components can become longer.

Figure 8:
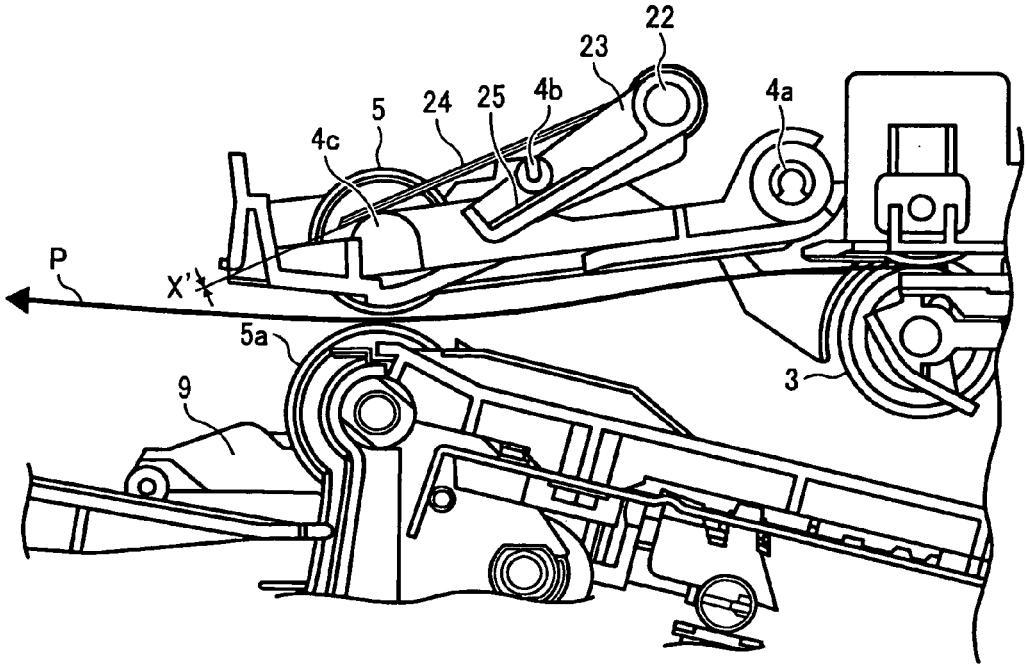
FIG. 8 is an elevation of an enlarged substantial portion illustrating a state near the discharge guide plate when the discharge guide plate is closed.

FIG. 8 is an elevation of an enlarged substantial portion near the pair of discharging rollers in a state when the discharge guide plate is closed. The paper P can be pinched between the pair of discharging rollers 5 and 5*a*, by closing the discharge guide plate 4 from the state shown in FIG. 7 to the state shown in FIG. 8, and is discharged onto the discharge tray 6 by the pair of discharging rollers 5 and 5*a*. Specifically, when a discharge guide plate driving gear 26 (see FIG. 6) is rotated in a direction for closing the discharge guide plate 4 by a driving source (not illustrated), the discharge guide plate supporting member 23 (see FIG. 6) rotates in a counterclockwise direction. As a result, the discharge guide plate 4 also rotates in a counterclockwise direction (from the state of FIG. 7 to the state of FIG. 8), which enables the paper P to be pinched when the pair of discharging rollers 5 and 5*a* forms a nip. In this process, the gap between the discharge guide plate pressurizing member 24 and the discharge guide plate pressurizing portion 4*c* becomes X' (0 millimeter) as illustrated in FIG. 8. The driven discharging roller 5 of the pair of discharging rollers 5 and 5*a* mounted on the discharge guide plate 4 is pressurized by the own weight of the discharge guide plate 4 or initial tension of the discharge guide plate pressurizing member 24 to produce conveying force. In this embodiment, a plate spring is used as the discharge guide plate pressurizing member 24 as illustrated in FIG. 6.

Figure 9:
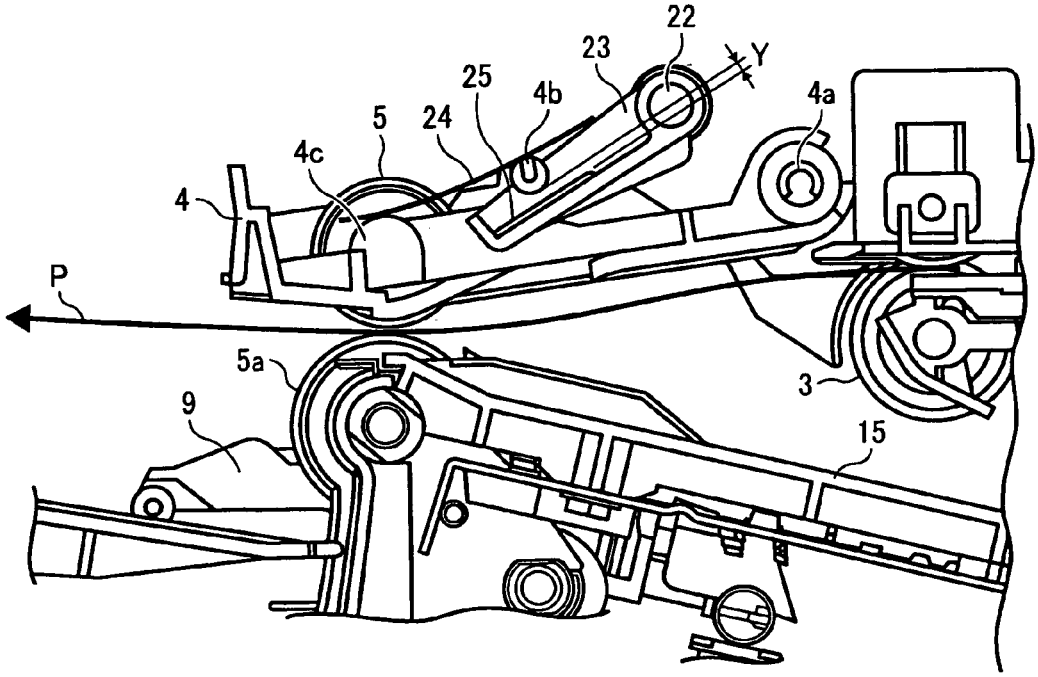
FIG. 9 is an elevation of an enlarged substantial portion illustrating a state near the discharge guide plate when the discharge guide plate is closed while thick paper is used.

FIG. 8 illustrates an example of conveying paper by the own weight of the discharge guide plate 4 or initial tension of the discharge guide plate pressurizing member 24. However, when thick paper is conveyed in such a conveying state, frictional force may be insufficient and thus cause a paper jam due to insufficient conveying force. As illustrated in FIG. 9, when larger conveying force is required, the discharge guide plate supporting member 23 is rotated in a counterclockwise direction as viewed in FIG. 9 to increase pressurizing force. Accordingly, frictional force necessary for conveyance can be obtained, and therefore, the occurrence of a paper jam can be prevented. FIG. 9 is an elevation of an enlarged substantial portion near the pair of discharging rollers when paper conveying force is maintained by pressurizing the driven conveying roller.

During this pressurized state, a gap Y is formed between the discharge guide plate supporting member 23 or the cushion 25 for a discharge guide plate and the outer surface of the boss 4*b* for supporting a discharge guide plate. In other words, the gap Y is formed in the state of FIG. 9 by the swinging action of the discharge guide plate supporting member 23 and is closed in the state shown in FIG. 8. As a result, the outer surface of the boss 4*b* for supporting a discharge guide plate comes in contact with the discharge guide plate supporting member 23 according to the swinging action of the discharge guide plate supporting member 23 so as to generate noise. Therefore, the cushion 25 for a discharge guide plate is placed between the boss 4*b* and the discharge guide plate supporting member 23 to reduce noise generated by the damping function of cushioning.

The CPU of the post-processing apparatus 200 controls the driving source that drives the discharge guide plate driving gear 26 based on signals indicating the thickness of paper (type of paper) transmitted from the image forming apparatus 100 and obtains necessary pressurizing force. In the figures, a single or a plurality of plate springs are used as the discharge guide plate pressurizing member 24. For example, elastic members that change their pressurizing force depending on the rotation angles, such as torsion springs can be used instead of the plate springs.

During straight discharge mode, as illustrated in FIG. 3A, the tapping roller 10 that switches back the paper P is not used. Therefore, while the tapping roller 10 is held above the driven discharging roller 5 of the pair of discharging rollers 5 and 5*a* mounted on the discharge guide plate 4 so as not to disturb the discharge of the paper P, the tapping roller 10 rotates in a conveying direction, that is, a reverse direction of the rotation direction of the driving roller 5*a* of the pair of discharging rollers.

Figure 4A:
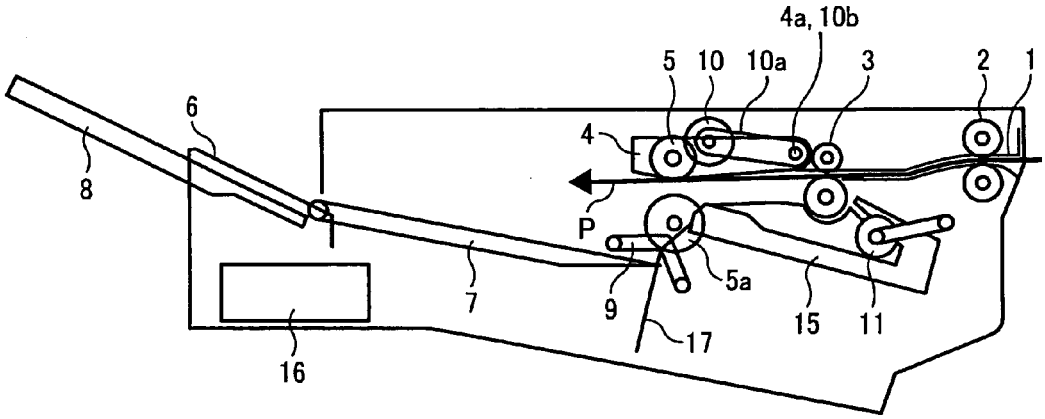
FIGS. 4A and 4B are schematic diagrams illustrating operation during staple discharge.
Figure 4B:
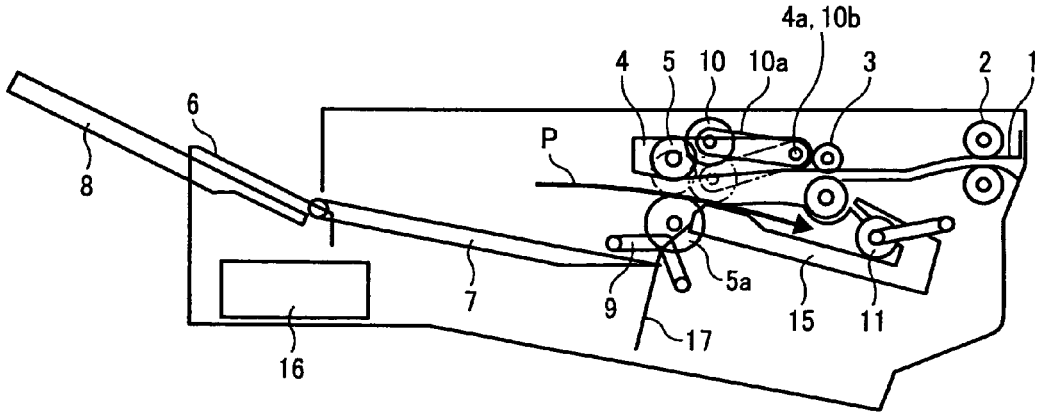

FIGS. 4A and 4B are schematic diagrams illustrating operation during staple discharge. During staple discharge, the paper P enters from the guide plate 1, is conveyed by the pair of inlet rollers 2 and the pair of shift rollers 3 in this order, and falls on the staple tray 15. Subsequently, the tapping roller 10 acts to perform longitudinal alignment together with the rear end returning roller 11 by abutting the rear end of the paper P against the rear end reference fence 12.

The tapping roller 10 is supported by the tapping roller supporting arm 10*a* as described above. The tapping roller supporting arm 10*a* swings (lifted and lowered) around the swing fulcrum 10*b* of the tapping roller supporting arm. The tapping roller 10 pulls paper to the rear end reference fence 12 by its rotation action and thus performs longitudinal alignment. In this process, the enlargement of the size of the post-processing apparatus 200 in a height direction is prevented by placing the swinging center of the swing fulcrum 10*b* of the tapping roller supporting arm 10*a* and the rotation fulcrum 4*a* of the discharge guide plate on the same axis.

When the longitudinal alignment performed by the tapping roller 10 is completed, lateral alignment is performed by the jogger fence 13. The longitudinal alignment by the tapping roller 10 and the lateral alignment by the jogger fence 13 are repeated until the last paper. After the last paper is stacked, the stapler 14 performs stitching process. When the stitching process is completed, the discharge guide plate 4 is closed, and then a bundle of paper is discharged onto the discharge tray 6 by the pair of discharging rollers 5 and 5*a*.

Figure 10:
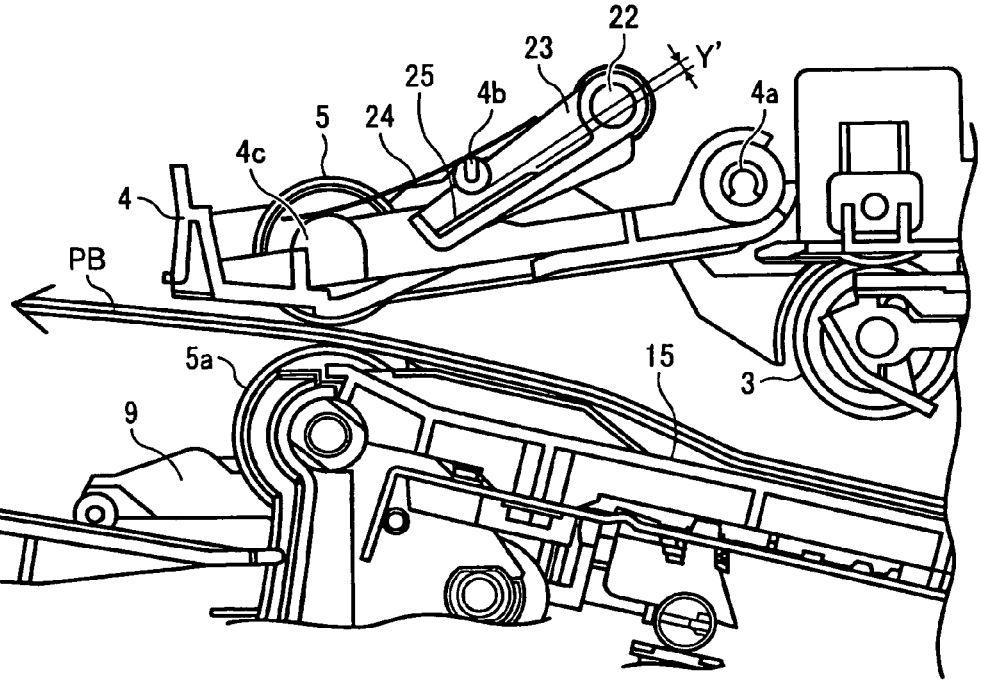
FIG. 10 is an elevation of an enlarged substantial portion illustrating a state near the discharge guide plate when the discharge guide plate is closed while a bundle of paper is discharged.

FIG. 10 is an elevation of a substantial portion illustrating a state near the discharging roller when a bundle of paper PB stitched is discharged. In this process, as illustrated in FIG. 10, a gap Y' is formed between the discharge guide plate supporting member 23 or the cushion 25 for a discharge guide plate and the boss 4*b* for supporting a discharge guide plate is changed depending on the number of sheets of the bundle of paper PB. This adjusts pressurizing force applied on the discharge guide plate pressurizing portion 4*c*, that is, pressure applied on the bundle of paper SB. The CPU of the post-processing apparatus 200 recognizes the number of sheets of the bundle of paper SB based on signals transmitted from the CPU of the image forming apparatus 100 and controls the rotation angle of the discharge guide plate supporting member 23 according to this number of sheets.

As with the case of the paper P, at the discharge tray 6, the discharge tray movable unit 7 once descends each time when the bundle of paper SB is discharged and ascends in a state where the rear end of the bundle is pressed by the rear end presser 9 that has been moved to a position not disturbing the discharge while the rear end passes through the pair of discharging rollers 5 and 5*a*. The upstream side of the discharge tray movable unit 7 in a paper conveying direction moves up and down depending on the stacked amount of the bundle of paper SB.

As described above, this embodiment has the following effects and similar effects.

1) The discharge guide plate does not need to be rotated by a link mechanism provided at the upper side of the opening and closing guide plate as in conventional examples because the discharge guide plate pressurizing member is attached to the rocking driving shaft 22 of the discharge guide plate supporting member 23, and thus a space necessary for installing the link mechanism becomes unnecessary. As a result, the paper processing apparatus can be downsized to have height with which the paper processing apparatus is mountable on the body 100A of the image forming apparatus 100.

2) The discharge guide plate pressurizing member 24 is separated from the discharge guide plate 4 when pressurization is unnecessary. Therefore, unnecessary pressure is not applied on the discharge guide plate 4 or the pair of discharging rollers 5 and 5*a*, which can extend service life and enhance reliability.

3) Conveying force of the paper P or the bundle of paper PB can be secured because pressurizing force is changed depending on thickness of the paper P and the bundle of paper PB, and damage on paper can be avoided because unnecessary load is not applied.

4) The silencing during the operation of equipment can be achieved because the cushion 25 for a discharge guide plate is provided at the discharge guide plate supporting member 23 and absorbs contact sound generated when the outer periphery of the boss 4*b* for supporting a discharge guide plate comes in contact with the discharge guide plate supporting member 23 while the discharge guide plate 4 is opened.

According to the present invention, provided is a paper processing apparatus, which can be mounted on and discharge paper in a limited space, that is, in the body of an image forming apparatus, which has stable conveying force regardless of the thickness of paper and of a bundle of paper, and which can perform paper process without damaging paper.

In an embodiment of the present invention described later, a staple tray corresponds to a reference numeral 15, a discharge tray corresponds to a reference numeral 6, discharging units correspond to a pair of discharging rollers 5 and 5*a* and an (opening and closing) discharge guide plate 4, a rear end reference fence corresponds to a reference numeral 12, and a paper returning unit corresponds to a tapping roller 10. A supporting unit corresponds to a rotation fulcrum 4*a*, a contact and separation unit corresponds to a discharge guide plate supporting member 23, a pressurizing unit corresponds to a discharge guide plate pressurizing member 24, a second contact and separation unit corresponds to a tapping roller supporting arm 10*a*, a driving roller corresponds to a reference numeral 5*a*, and a driven roller corresponds to a reference numeral 5. Moreover, a guide member corresponds to an (opening and closing) discharge guide plate 4, a connecting shaft corresponds to a boss 4*b* for supporting a discharge guide plate, a rocking driving shaft corresponds to a reference numeral 22, a cushioning unit corresponds to a cushion 25 for a discharge guide plate, a paper processing apparatus corresponds to a reference numeral 200, and an image forming apparatus corresponds to a reference numeral 100.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. A paper processing apparatus including a staple tray on which paper conveyed from a previous stage may be temporarily stacked, aligned, and stapled to be discharged onto a discharge tray, the paper processing apparatus comprising:

a discharging unit, configured to discharge the paper onto the staple tray;

a paper returning unit, configured to reverse the paper discharged by the discharging unit and configured to perform alignment in a conveying direction by abutting the paper against a rear end reference fence;

a supporting unit, configured to support the discharging unit in a state capable of coming in contact with or separating from the paper;

a contact and separation unit by which the discharging unit comes in contact with or separates from the paper; and a pressurizing unit configured to be moved by the contact and separation unit, wherein the pressurizing unit does not load the discharging unit in a standby state where the discharging unit is held apart from the paper, and apply contact pressure in a state where the discharging unit is in contact with the paper, wherein the discharging unit includes:

a driving roller and a driven roller, and a guide member, configured to rotatably hold the driven roller at one end of the guide member, the guide member being supported by the supporting unit at the other end of the guide member, wherein one end of the contact and separation unit is swingably connected to the guide member via a connecting shaft, and wherein another end of the contact and separation unit is swingably supported by a rocking shaft provided at a position between the connecting shaft and the supporting unit, proximate to a main body.

2. The paper processing apparatus according to claim 1, wherein the pressurizing unit is supported by the rocking shaft.

3. The paper processing apparatus according to claim 1, wherein the contact and separation unit is separated from the outer periphery of the connecting shaft in a state where the discharging unit comes in contact with the paper and the pressurizing unit is capable of applying the contact pressure.

4. The paper processing apparatus according to claim 3, further comprising a cushioning unit that absorbs sound generated when the outer periphery of the connecting shaft comes in contact with a contact portion of the contact and separation unit.

5. An image forming apparatus comprising a paper processing apparatus, wherein the paper processing apparatus includes a staple tray on which paper conveyed from a previous stage may be temporarily stacked, aligned, and stapled to be discharged onto a discharge tray, the paper processing apparatus comprising:

a discharging unit, configured to discharge the paper onto the staple tray;

a paper returning unit, configured to reverse the paper discharged by the discharging unit and configured to perform alignment in a conveying direction by abutting the paper against a rear end reference fence;

a supporting unit, configured to support the discharging unit in a state capable of coming in contact with or separating from the paper;

a contact and separation unit by which the discharging unit comes in contact with or separates from the paper; and a pressurizing unit configured to be moved by the contact and separation unit, wherein the pressurizing unit does not load the discharging unit in a standby state where the discharging unit is held apart from the paper, and apply contact pressure in a state where the discharging unit is in contact with the paper, wherein the discharging unit includes:

a driving roller and a driven roller, and a guide member, configured to hold the driven roller at one end of the guide member, the guide member being supported by the supporting unit at the other end of the guide member, wherein one end of the contact and separation unit is swingably connected to the guide member via a connecting shaft, and wherein another end of the contact and separation unit is swingably supported by a rocking shaft provided at a position between the connecting shaft and the supporting unit, proximate to a main body.

* * * * *